United States Patent [19]

Howell

[11] 4,228,714

[45] Oct. 21, 1980

[54] MULTIPLEX CHIME GENERATOR

[75] Inventor: Stephen L. Howell, Jasper, Ind.

[73] Assignee: Kimball International, Inc., Jasper, Ind.

[21] Appl. No.: 158

[22] Filed: Jan. 2, 1979

[51] Int. Cl.[3] ..... G10H 1/26; G10H 5/10

[52] U.S. Cl. ..... 84/1.01; 84/1.22; 84/1.24

[58] Field of Search ..... 84/1.01, 1.03, 1.13, 84/1.24, 1.26, 1.22

[56] References Cited

U.S. PATENT DOCUMENTS

| | | | |
|---|---|---|---|
| 3,417,189 | 12/1968 | Kramer, Jr. | 84/1.01 X |
| 3,499,093 | 3/1970 | Wayne, Jr. et al. | 84/1.24 |
| 3,610,800 | 10/1971 | Deutsch | 84/1.01 |
| 3,697,661 | 10/1972 | Deutsch | 84/1.01 |
| 3,875,842 | 4/1975 | Kmetz | 84/1.01 |
| 3,971,283 | 7/1976 | Wayne, Jr. | 84/1.26 |
| 4,011,784 | 3/1977 | Fukui | 84/1.01 |
| 4,012,702 | 3/1977 | Weber | 84/1.13 X |
| 4,101,885 | 7/1978 | Blum | 84/1.01 X |
| 4,110,750 | 8/1978 | Heyning et al. | 84/1.01 X |
| 4,112,802 | 9/1978 | Robinson et al. | 84/1.01 |

*Primary Examiner*—Stanley J. Witkowski
*Attorney, Agent, or Firm*—Albert L. Jeffers; John F. Hoffman

[57] ABSTRACT

A multiple pitch generator, in particular a chime generator, incorporated in an electronic organ of the multiplexed variety wherein the keyboard is scanned and a cyclically recurring serial data stream produced wherein keydown pulses appear in time slots corresponding to depressed keys of the keyboard. The chime generator produces a plurality of tones in response to the actuation of a single key of the solo keyboard, for example, wherein the tones are those necessary to closely simulate a chime sound. This is accomplished by sequentially passing the serial data stream containing the keydown pulse through a series of shift registers which insert in the data stream pulses in subsequent time slots corresponding to the next three lowest tones making up the chime. Since a true chime tone also includes a note five notes above the note played, the partial chime data stream is delayed five time slots and this data stream is summed with the initial data stream carrying the original keydown pulse in the time slot for the note played so as to position the additional pulse in its proper location ahead of the pulse for the actuated key. In order to then transpose the pulses in the data stream back to their proper positions for the key played, the latching pulse for the demultiplexer is delayed five time slots.

13 Claims, 3 Drawing Figures

MULTIPLEX CHIME GENERATOR

BACKGROUND OF THE INVENTION

The present invention relates to a method and apparatus for generating multiple pitch tones in multiplexed organs, and more particularly to generate the frequencies which simulate the tone of a chime.

If it is known that to simulate the sound produced by a chime, a predetermined combination of pitches are sounded in flute voices and with a certain amount of sustain. For a C note, the notes E, C, G, C and F, in that order, are played.

To key these notes employing prior art techniques would require a bank of keyers for each of the notes in addition to the note played. Because this is very costly in terms of hardware, many organs in the past have deleted one or more of the notes in the chime, thereby reducing the number of additional keyers necessary. In the case of a C chime, the E and F notes would be deleted. Although this created a chime-like sound, it fell short of producing a sound truly simulative of a chime. The chime generators would use either resistors or multiple contact key switches to sum together the frequencies to be keyed.

In multiplexed organs, one prior art technique for sounding a plurality of tones or voices for the depression of a single key is to pass the serial data stream through a shift register and then connect selected stages of the shift register to an output line. This results in a plurality of additional keydown pulses appearing in time slots subsequent to the initial keydown pulse and it is well suited for voicing. The difficulty encountered when using this technique for chime generation, however, is that the tones necessary for a true chime lie on both sides of the note played so that simple delaying and reinsertion of the initial keydown pulse will not produce a keydown pulse in the time slot ahead of the note-played pulse in the data stream. Although the keydown pulse could be shifted through a long shift register so as to appear in the data stream for the next scan of the keyboard, a shift register of this length is impractical for reasons of cost.

SUMMARY OF THE INVENTION

In order to overcome the above-discussed disadvantages of the prior art, the present invention provides a technique for generating in the serial data stream keydown pulses in time slots corresponding to all of the pitches making up a chime tone through the use of relatively short length delays. This technique is applicable not only to chime generation, but to other applications where it is desired to produce a plurality of pitches for each key which is depressed.

In order to produce respective tones five, twelve and twenty notes lower than the note played, the data stream is shifted sequentially through three delay devices, such as shift registers, wherein the outputs are summed together so as to provide a partial chime data stream containing all of the chime data except the note which is five notes higher than the note played. To insert a keydown pulse in a time slot for this note, the partial chime data stream is delayed by five bits and then summed together with the original data stream. To transpose the keydown pulses back to their proper positions in the data stream, the synchronizing or latching pulse for the serial-to-parallel conversion performed by the demultiplexer is also delayed by five bits.

Specifically, the present invention contemplates a pitch generator incorporated in an electronic musical instrument including a keyboard having playing keys, a multiplexer for scanning the keys and producing a cyclically recurring binary serial format data word having time slots corresponding to respective keys of the keyboard and a keydown pulse in a time slot corresponding to an actuated key of the keyboard, a demultiplexer synchronized with the multiplexer and connected to receive the serial format data word for converting the data word to a parallel format signal, and tone generating and keying means for producing tones associated with the keys corresponding to time slots in the serial format data word in which keydown signals appear. The pitch generator of the present invention comprises means connected between the multiplexer and demultiplexer for inserting in the serial format data word a keydown pulse in an advance time slot located ahead of the time slot corresponding to the actuated key whereby tones associated with the actuated key and the key corresponding to the advance time slot will be produced.

The method according to the present invention comprises the steps of inserting in the data stream pulses in predetermined time slots subsequent to the time slot in which the keydown pulse corresponding to the actuated key appears, shifting all the pulses to new time slots subsequent to the respective original time slots in which they appeared wherein the relative spacing between the individual pulses remains unchanged, inserting a further pulse in a time slot ahead of said new time slots, and subsequently shifting all of the pulses ahead in the data stream so that all the pulses, except said further pulse appear in their original time slots, and such that the respective spacing between the individual pulses remains unchanged.

It is an object of the present invention to provide a pitch generator for use in multiplexed electronic organs and the like wherein keydown pulses can be inserted in the serial data stream both ahead and behind the keydown pulse corresponding to the depressed key of the keyboard.

Another object of the present invention is to provide a multiplex chime generator wherein all of the notes necessary for good chime simulation can be sounded by manipulation of the serial data stream produced by actuating one or more keys of the solo keyboard.

Yet another object of the present invention is to provide a multiplex chime generator wherein the use of long shift registers is avoided.

Yet another object of the present invention is to provide a multiplex chime generator which is economical to manufacture, and which may be easily incorporated into existing organ circuitry.

These and other objects and features of the invention and the manner of attaining them will become more apparent by reference to the detailed description of a preferred embodiment of the invention taken in conjunction with the accompanying drawings.

DETAILED DESCRIPTION

Figure 1:
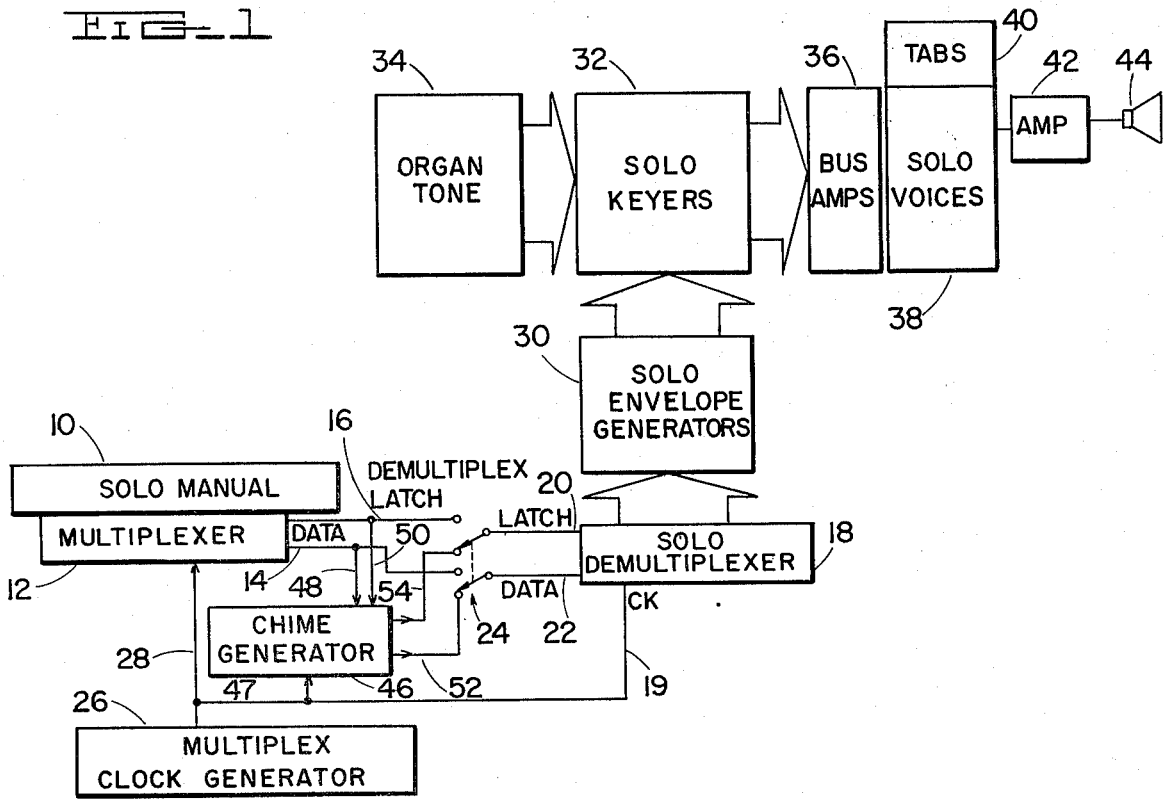
FIG. 1 is a simplified block diagram of an electronic organ incorporating the chime generator according to the present invention.

Referring now to the drawings and in particular to FIG. 1, a multiplexed electronic organ incorporating the chime generator of the present invention is illustrated. The organ comprises a solo manual 10, which is multiplexed by multiplexer 12 to produce a serial data stream on line 14. The serial data stream comprises a plurality of time slots corresponding on a one-to-one basis to the keys of solo manual 10 wherein pulses appear in time slots corresponding to depressed keys of the solo manual 10. It should be noted that, in the case of single manual organs, the solo manual will comprise the keys normally played by the right hand, and the accompaniment manual (not shown) will comprise the keys normally played by the left hand. Also connected to multiplexer 12 is a demultiplex latch line 16 on which a pulse appears at the end of a scan of the solo manual. This pulse is for the purpose of synchronizing the demultiplexer 18 with multiplexer 12 to convert the serial data stream to a parallel format in a manner well known in the art.

Demultiplexer 18 includes a latch input line 20 on which the aforementioned demultiplex latch pulse appears, and a data input line 22, which is connected to receive the serial data stream from multiplexer 12. Lines 20 and 22 will be connected to lines 16 and 14 of multiplexer 12 when switch 24 is in the upper position. Although demultiplexer 18 is shown as being connected directly to multiplexer 12, in the case of more complex electronic organs where a number of easy play and automatic play features are incorporated, substantial circuitry may be interposed between multiplexer 12 and demultiplexer 18. For the purposes of the present invention, however, the demultiplexer 18 has been shown as being connected directly to multiplexer 12 so as to simplify the drawings and description and enable a more ready understanding of the invention. Multiplexer 12 and demultiplexer 18 are clocked by multiplex clock generator 26 over lines 28 and 19, respectively.

Connected to the outputs of demultiplexer 18 are solo envelope generators 30, which impart to the keying signals attack and decay characteristics selected by the performer. In the case of chime simulation, the keying signals will have a relatively long sustain. Solo keyers 32 are connected between tone generator 34 and bus amplifiers 36. The output of amplifiers 36 are fed through solo voicing circuitry 38, which is controlled by tabs 40, to power amplifier 42 and speaker 44.

The chime generator 46 of the present invention, which is clocked over line 47 by multiplex clock generator 26, has a data input line 48, a demultiplex latch input line 50, a data output line 52, and a multiplex latch output line 54. Output lines 52 and 54 may be selectively coupled to demultiplexer input lines 22 and 20 when mechanically ganged switch 24 is switched to the lower position, as illustrated in FIG. 1. With switch 24 in this position, chime generator 46 intercepts the multiplexed data and demultiplex latch signals from multiplexer 12 and creates new signals for the serial data and latch signal.

Figure 2:
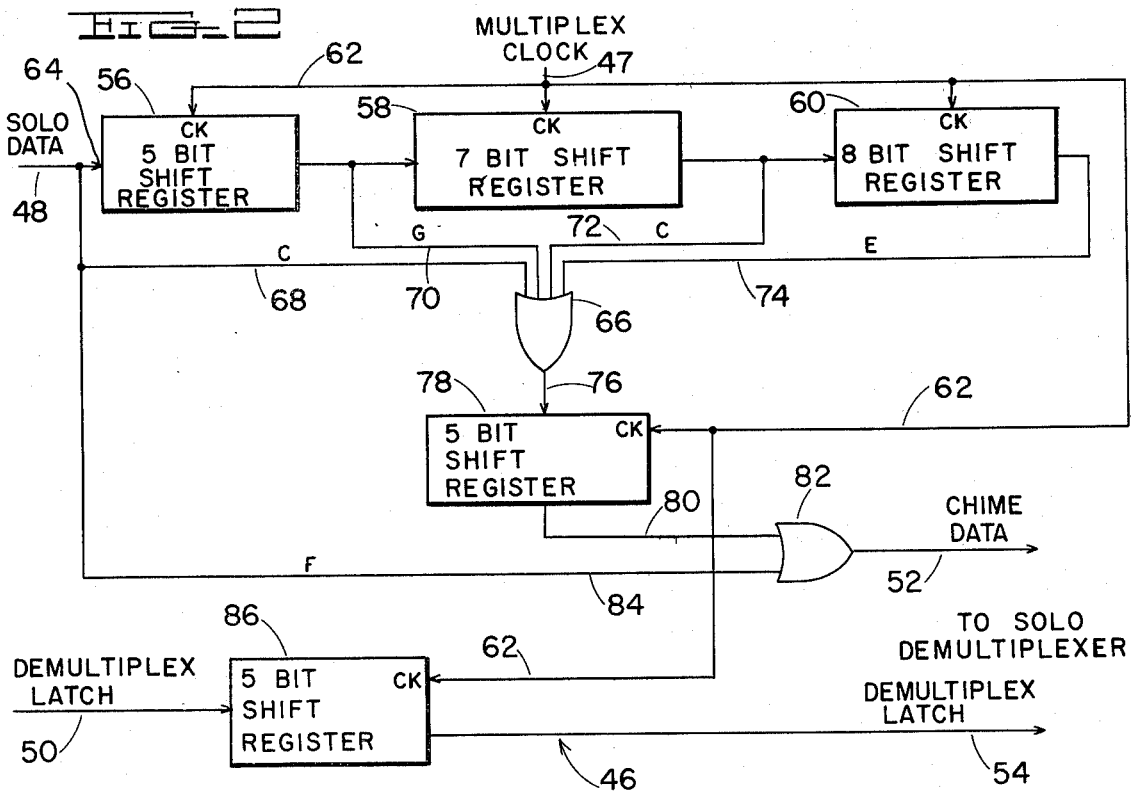
FIG. 2 is a more detailed block diagram of the chime generator.

With reference now to FIG. 2, the chime generator 46 is shown in greater detail. It comprises a five bit shift register 56, a seven bit shift register 58, and an eight bit shift register 60, wherein shift registers 56, 58 and 60 are connected in series and are clocked by the clock train on bus 62. The input 64 for shift register 56 is connected to the solo data input line 48 for chime generator 46. The solo data input line 48 and the output for shift registers 56, 58 and 60 are connected to the inputs of NOR gate 66 over lines 68, 70, 72 and 74, respectively. NOR gate 66 performs a summing function and produces a partial chime serial data stream on its output line 76.

Line 76 is connected to the input of five bit shift register 78, which is also clocked by the pulse train on bus 62, and has its output 80 connected to one of the inputs of NOR gate 82. The other input 84 of NOR gate 82 is connected to the solo data input line 48. The composite chime data stream appears at the output 52 of NOR gate 82.

The demultiplex latch signal on line 50 is delayed by five time slots by five bit shift register 86, which is also clocked by the clocking pulse train on bus 62. The output of shift register 86 is connected to demultiplex latch output line 54.

Basically, the system illustrated in FIG. 2 sequentially delays the solo data stream on line 48 by five, seven and eight time slots in order to produce four separate data streams, which are then summed together to form a partial chime data stream. In order to insert the note which appears in the data stream ahead of the note corresponding to the depressed key, the partial chime data stream is delayed by five time slots and then summed together with the original data stream in NOR gate 82 to produce the composite chime data stream on line 52. Since this data stream is transposed downwardly by five time slots, it is necessary to delay the demultiplex latch signal on line 50 by five time slots.

Figure 3:
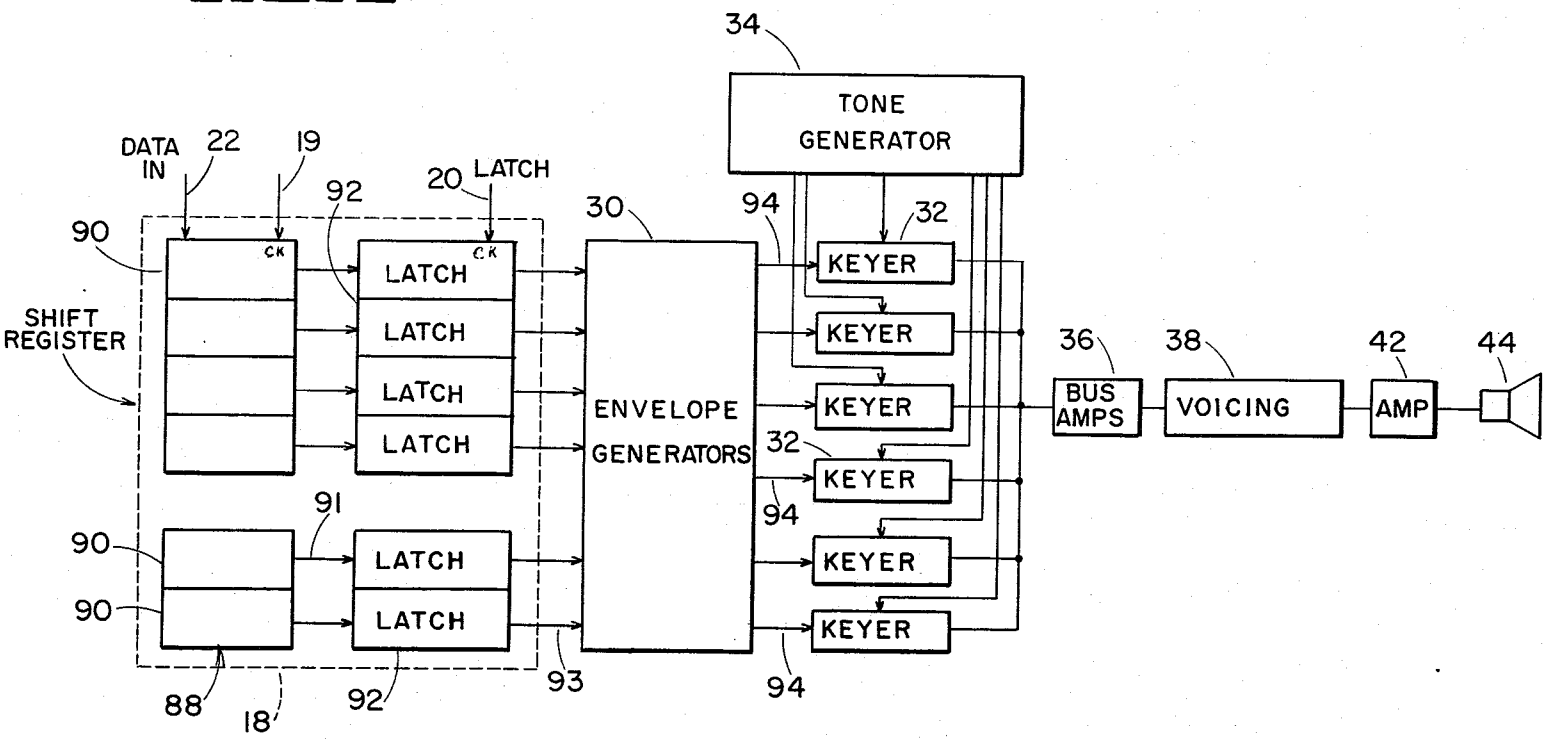
FIG. 3 is a more detailed block diagram of an exemplary demultiplexer and keying arrangement for the electronic organ of FIG. 1.

Turning now to FIG. 3, an exemplary demultiplexing and keying arrangement is illustrated. Demultiplexer 18 comprises a shift register 88, which has as many stages 90 as there are multiplexed keys in solo manual 10. The data stream on line 22 is shifted through shift register 88 in synchronism with the clock pulses appearing on line 19. A plurality of latches 92 have their inputs connected to the respective outputs of shift register stages 90 over lines 91, and have their outputs connected to the inputs of envelope generators 30 over lines 93. When the demultiplex latch pulse appears on line 20, latches 92 will be clocked so as to transfer to their outputs the data appearing at their inputs at that particular moment in time. In the non-chime mode, the latch signal will appear on line 20 at the end of each scan of solo manual 10.

The pulses latched by latches 92 cause envelope generators 30 to produce keying signals on lines 94 having the desired attack and decay characteristics. The signals on lines 94 control keyers 32 to key the appropriate tone frequencies from tone generator 34 to bus amplifiers 36.

In order to describe the operation of the system, it will be assumed that a C note is being played on the solo keyboard. When solo manual 10 is multiplexed by multiplexer 12, and switch 24 is in the position shown in FIG. 1, the data stream appearing at the input line 48 for chime generator 46 will contain a single keydown pulse in the time slot corresponding to that key. Since line 48 is connected to the input of NOR gate 66, as the data stream appears at its output 76, a keydown pulse will appear in the same time slot. The data stream also passes through shift register 56 and is delayed by five time slots before appearing on output line 70, which is also connected to NOR gate 66. Thus, a keydown pulse will appear in the data stream at the output 77 five time slots after the first keydown pulse. The data stream then passes through seven bit shift register 58 and is delayed by seven time slots so that the data stream appearing at the output 76 of NOR gate 66 contains a keydown pulse seven time slots after the second keydown pulse and twelve time slots, which is a full octave, after the first keydown pulse. The first keydown pulse corresponds to a C note, the second keydown pulse to the G note in the octave immediately below the C note, and the third keydown pulse corresponds to a C note one octave below the first C note. The data stream then passes through eight bit shift register 60 and is delayed by an additional eight time slots so that the data stream appearing on output 76 contains a keydown pulse eight time slots later than the second C note and twenty time slots later than the first C note. This corresponds to an E note in the second octave below the first C note.

It has been determined that the F note for the chime must be higher in frequency than the C note which is being played. Although the data stream could be delayed by an additional fifty-nine time slots, for a sixty-four note solo manual, a shift register of this length is, for cost reasons, impractical. In order to insert the keydown pulse for the F note ahead of the first C note keydown pulse in the data stream, the data stream on output line 76 is delayed again by five time slots by shift register 78. Thus, the data stream appearing on output line 80 at the input to NOR gate 82 will contain keydown pulses for the G and D notes in the octave immediately below the C note being played, and the G and B notes in the next octave lower. This data stream is then summed with the original data stream so that the keydown pulse corresponding to the C note which was originally played will appear in the time slot five places ahead of the highest "G" note (formerly the C note played on the solo manual). This is because the F note which must be played in five time slots higher than the C note that is actually being played. This chime data stream appears on line 52 and is fed through the input 22 of demultiplexer shift register 88.

To transpose the five keydown pulses back to their proper position, which is five notes higher and, therefore, five time slots further ahead in the data stream, demultiplex latch pulse on line 50 is delayed by five bits and shift register 86. This will cause the data stream to shift down shift register 88 by an additional five places before the data stream is latched by latches 92 to the inputs of envelope generator 30. Since both the data stream and latch pulse command are delayed by equal amounts, the demultiplexer 18 perceives no difference and the B, G, D and G keydown pulses in the data stream on lines 52 will be shifted back to their original positions. The C keydown pulse in the data stream on line 52, however, will also be shifted by five places and will appear as an F note five notes above the C note played on solo manual 10, which is the proper note for a C note chime.

With the organ utilizing the chime data stream, a single solo flute tab 40 will be actuated, and a long sustain will be selected for envelope generators 30. When a single key is struck briefly, this will simulate the sound produced by a chime.

In order to prevent wraparound, the organ may be constructed such that the chime generation feature is not available for the five highest keys of the solo manual. Alternatively, the demultiplexer 18 could be extended by an additional five time slots and the multiplexer 12 delayed by five time slots before commencing the next scan of manual 10. Furthermore, it may be desirable to limit the chime generation feature to monophonic operation so that only one key at a time will be capable of producing a chime tone.

The present invention is not limited only to chime generation, but also to other multiple-pitch generation applications where more than one tone is desired for each key depressed, as in the simulation of other instruments.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. In an electronic musical instrument including a keyboard having playing keys, multiplex means for scanning said keys and producing a cyclically recurring binary serial format data word having time slots corresponding to respective keys of the keyboard and a keydown pulse in a time slot corresponding to an actuated key of the keyboard, demultiplex means synchronized with said multiplex means and connected to receive said serial format word for converting said serial format word to a parallel format signal, and tone generating and keying means controlled by said demultiplex means for producing tones associated with the keys corresponding to time slots in said serial format data word in which keydown signals appear, the improvement being a pitch generator comprising means connected between said multiplex and demultiplex means for inserting in said serial format word a keydown pulse in an advance time slot located ahead of said time slot corresponding to said actuated key whereby tones associated with said actuated key and the key corresponding to said advance time slot will be produced, the keydown pulse in said advance time slot being a predetermined number of time slots ahead of said time slot corresponding to said actuated key and being independent of the actuation of any other key of the keyboard.

2. In an electronic musical instrument having a keyboard with playing keys, a multiplexer for scanning the playing keys to produce a cyclically recurring serial data stream having time slots corresponding to the respective keys of the keyboard and a keydown pulse in a time slot corresponding to an actuated key of the keyboard, a demultiplexer connected to receive the serial data stream, and tone generating and keying circuitry controlled by said multiplexer for producing tones associated with the keys corresponding to time slots in which keydown pulses appear, the improvement being the method of multiple pitch generation comprising the steps of:

inserting in the serial data stream pulses in predetermined time slots subsequent to the time slot in which the keydown pulse corresponding to the actuated key appears, shifting all of the pulses to new time slots subsequent to the respective original time slots in which they appeared wherein the relative spacing between the individual pulses remains unchanged, inserting a further pulse in a time slot ahead of the new time slots, and subsequently shifting all of the pulses ahead in the data stream so that all of the pulses except said further pulse appear in their original time slots and such that the relative spacing between the individual pulses remains unchanged.

3. In an electronic musical instrument having a keyboard with playing keys, a multiplexer for scanning the playing keys to produce a cyclically recurring serial data stream having time slots corresponding to the respective keys of the keyboard and a keydown pulse in a time slot corresponding to an actuated key of the keyboard, a demultiplexer connected to receive the serial data stream, and tone generating and keying circuitry controlled by said demultiplexer for producing tones associated with the keys corresponding to time slots in which keydown pulses appear, the improvement being the method of multiple pitch generation comprising the steps of:

generating a second serial data stream synchronized with the first-mentioned serial data stream and comprising pulses in predetermined time slots subsequent to the time slot in which the keydown pulse corresponding to the actuated key appears, shifting all of the pulses in said second serial data stream to new time slots subsequent to the respective original time slots in which they appeared wherein the relative spacing between the individual pulses remains unchanged, inserting a further pulse in a time slot in said second data stream ahead of the new time slots, and subsequently shifting all the pulses in said second data stream ahead in the data stream so that all of the pulses except said further pulse appear in their original time slots and such that the relative spacing between the individual pulses remains unchanged.

4. In an electronic musical instrument including a keyboard having playing keys, the improvement being a chime generator comprising:

multiplex means for scanning said keyboard and producing a cyclically recurring serial data stream having time slots corresponding to respective keys of the keyboard and a keydown signal in a time slot corresponding to an actuated key of the keyboard, an input terminal connected to receive said serial data stream, means connected to said input terminal for inserting in said serial data stream keydown signals in the fifth, twelfth and twentieth time slots subsequent to said time slot corresponding to an actuated key so as to form a partial chime serial data stream synchronized with said multiplex means, means connected to receive said partial chime data stream for delaying said partial chime data stream by five time slots, means connected to said means for delaying for combining said first mentioned data stream with the delayed said chime data stream to produce a composite chime data stream, demultiplex means synchronized with said multiplex means and having a data input connected to said means for combining for demultiplexing said composite chime data stream, and means associated wex means for advancing the keydown signals ahead in said composite chime data stream by five time slots.

5. In an electronic musical instrument including a keyboard having playing keys, multiplex means for scanning said keys and producing a cyclically recurring serial data stream having time slots corresponding to respective keys of the keyboard and a keydown signal in a time slot corresponding to an actuated key of the keyboard, demultiplex means synchronized with said multiplex means and connected to receive said serial data stream for demultiplexing said serial data stream, the improvement being a pitch generator connected between said multiplex and demultiplex means comprising:

means responsive to said serial data stream for inserting keydown signals in a plurality of selected time slots subsequent to said time slot corresponding to an actuated key so as to form a multiple pitch serial data stream, means connected to receive said multiple pitch serial data stream for shifting said keydown signals therein by a given interval of time slots to respective new time slots in said multiple pitch data stream subsequent to the original time slots thereof and wherein the time slot spacing between said keydown signals remains unchanged, means responsive to said multiple pitch data stream for inserting a further keydown signal in a time slot in said multiple pitch data stream earlier than said new time slots, said means for inserting having an output at which said multiple pitch serial data stream including said further keydown signal appears, and means connected between said last mentioned means for inserting and said demultiplex means for shifting said keydown signals ahead in said serial data stream by said given interval so that all of the keydown signals appear in time slots in said multiple pitch data stream earlier than at the output of said means for inserting.

6. The electronic musical instrument of claim 5 including circuitry connecting said multiplex means to said demultiplex means, and switch means for selectively connecting said pitch generator in series with said circuitry so as to shunt said first mentioned serial data stream through said pitch generator.

7. The electronic musical instrument of claim 5 including means for a latch signal for causing said demultiplex means to convert said multiple pitch serial data stream to a multiple pitch parallel format signal, said means for shifting said keydown signals ahead delayed said latch signal for a number of time slots equal to said given interval of time slots.

8. In an electronic musical instrument including a keyboard having playing keys, the improvement being a pitch generator comprising:

multiplex means for scanning said keyboard and producing a cyclically recurring signal data stream having time slots corresponding to respective keys of the keyboard and a keydown signal in a time slot corresponding to an actuated key of the keyboard, an input terminal connected to receive said data stream, means connected to said input terminal for inserting in said serial data stream one or more keydown signals in respective selected time slots subsequent to said time slot corresponding to an actuated key so as to form a multiple-pitch serial data stream synchronized with said multiplex means, means connected to receive said multiple pitch data stream for delaying said multiple pitch data stream by a given interval, means connected to said means for delaying for combining said first mentioned data stream with the delayed said multiple pitch data stream to produce a composite serial data stream, demultiplex means synchronized with said multiplex means and having a data input connected to said means for combining for demultiplexing said composite data stream, and means associated with said demultiplex means for advancing the keydown signals ahead in said composite data stream by said given interval prior to demultiplexing thereof.

9. The electrical musical instrument of claim 8 wherein said means for inserting comprises a plurality of serially connected delay means connected to said input terminal, each of said serially connected delay means having an output, and means for summing the outputs of said serially connected delay means and said first mentioned serial data stream to form said multiple pitch serial data stream.

10. The electronic musical instrument of claim 9 wherein said delay means are shift registers clocked in synchronism with said multiplex means.

11. The electronic musical instrument of claim 9 adapted for producing chime pitches wherein said means for inserting comprises first, second and third serially connected said delay means wherein said first serially connected delay means produces a delay of five time slots, said second serially connected delay means produces a delay of seven time slots, and said third serially connected delay means produces a delay of eight time slots.

12. The electronic musical instrument of claim 11 wherein said given interval is five time slots long.

13. The electronic musical instrument of claim 8 wherein said demultiplex means includes a latch input and means for converting said combined multiple pitch serial data stream to a parallel signal in response to a latch input signal fed to said latch input, and wherein said means for advancing functions to delay said latch signal by said given interval.

* * * * *

UNITED STATES PATENT AND TRADEMARK OFFICE

CERTIFICATE OF CORRECTION

PATENT NO. : 4,228,714

DATED : October 21, 1980

INVENTOR(S) : Stephen L. Howell

It is certified that error appears in the above-identified patent and that said Letters Patent are hereby corrected as shown below:

IN THE SPECIFICATION

Column 5, line 37, "in" should read ---is---.

IN THE CLAIMS

Column 7, Claim 4, line 64, "wex" should read ---with said demultiplex---.

Column 8, Claim 7, line 47, "delayed" should read ---delaying---.

Column 8, Claim 8, line 54, "signal" should read ---serial---.

Signed and Sealed this

Third Day of February 1981

[SEAL]

Attest:

RENE D. TEGTMEYER

Attesting Officer

Acting Commissioner of Patents and Trademarks